US011077352B1

(12) United States Patent
Greene, Jr.

(10) Patent No.: US 11,077,352 B1
(45) Date of Patent: Aug. 3, 2021

(54) TENNIS BALL PROJECTING MACHINE

(71) Applicant: Sports Tutor, Inc., Burbank, CA (US)

(72) Inventor: William James Greene, Jr., Burbank, CA (US)

(73) Assignee: Sports Tutor, Inc., Burbank, CA (US)

( * ) Notice: Subject to any disclaimer, the term of this patent is extended or adjusted under 35 U.S.C. 154(b) by 0 days.

(21) Appl. No.: 16/870,501

(22) Filed: May 8, 2020

(51) Int. Cl.
*A63B 69/40* (2006.01)

(52) U.S. Cl.
CPC ..... *A63B 69/406* (2013.01); *A63B 2069/405* (2013.01)

(58) Field of Classification Search
CPC . A63B 69/40; A63B 69/406; A63B 2069/405; A63B 2069/402; A63B 2069/403; A63B 2069/404
USPC ..... 124/78
See application file for complete search history.

(56) References Cited

U.S. PATENT DOCUMENTS 2,918,915 A 12/1959 Doeg
3,815,567 A 6/1974 Serra
3,820,789 A * 6/1974 Dudley ..... A63F 7/305 273/400
3,826,439 A * 7/1974 Moon ..... A63B 69/0079 473/142
4,025,071 A * 5/1977 Hodges ..... A63B 69/406 473/436
4,080,950 A * 3/1978 Paulson ..... A63B 69/406 124/1
4,203,413 A * 5/1980 Hodges ..... A63B 69/406 124/49
4,552,120 A * 11/1985 Nall ..... A63B 69/406 124/1
4,834,060 A * 5/1989 Greene ..... A63B 69/406 124/78
5,107,820 A * 4/1992 Salansky ..... A63B 69/40 124/48
5,257,615 A * 11/1993 Jones ..... A63B 47/02 124/49
5,490,493 A * 2/1996 Salansky ..... A63B 69/40 124/1
2003/0116151 A1* 6/2003 Wojtkiewicz ..... F41B 4/00 124/78
2013/0228138 A1* 9/2013 Hamill ..... A01K 15/025 119/707
2014/0121043 A1* 5/2014 Blanning ..... A63B 69/38 473/459
2016/0262351 A1* 9/2016 Hamill ..... A01K 15/027
2016/0296814 A1* 10/2016 Hsu ..... A63B 65/12
2017/0326428 A1* 11/2017 Qian ..... A63B 69/406

* cited by examiner

*Primary Examiner* — John E Simms, Jr.
(74) *Attorney, Agent, or Firm* — Woodard, Emhardt, Henry, Reeves & Wagner, LLP

(57) ABSTRACT

A tennis ball projecting machine including a support member, a rotatable wheel mounted on one side of the support member, a wheel motor on the other side of the support member, a curved rail below the wheel, a tennis ball hopper above the support member, a surface between the hopper and the machine having a feed opening where at least a portion of the feed opening is on the other side of the support member, and a rotatable body with one or more ball openings that periodically aligns with the feed opening to permit a tennis ball to pass through the feed opening.

26 Claims, 10 Drawing Sheets

TENNIS BALL PROJECTING MACHINE

BACKGROUND

This disclosure is in the field of tennis ball projecting machines.

Tennis ball projecting machines are operated for player practice. Prior art machines for this purpose typically have been complex, cumbersome and expensive. It is a general object of this invention to provide a tennis ball projecting machine that is simple to operate, comparatively compact and comparatively inexpensive.

SUMMARY

A tennis ball projecting machine comprising a support member with a first side and a second side opposite the first; a vertically oriented wheel rotatably mounted on the first side of the support member about a horizontal axis of rotation; a wheel motor mounted on the second side of the support member with its output coupled to the wheel on the first side of the support member to rotate the wheel, a curved rail positioned below the wheel that includes a ball entry portion, a ball drive portion and a ball lifting portion, where the curved rail is positioned on the first side of the support member, where the entry portion is slanted downwardly toward the wheel such that tennis balls on the entry portion roll toward the wheel, and where tennis balls on the drive portion are pinched between the wheel and curved rail for acceleration by the wheel and where the ball-lifting portion is slanted upwardly away from the wheel such that tennis balls on the ball-lifting portion move upward for being thrown from the exit portion with an upward trajectory, a tennis ball hopper positioned vertically above the support member, an upper surface positioned under the tennis ball hopper, where the upper surface defines a feed opening adapted to allow selective passage of a tennis ball and where at least the portion of the feed opening that tennis balls pass through is positioned on the second side of the support member, a rotatable body positioned above the top surface, where the rotatable body defines a ball opening, wherein the rotatable body is positioned such that, when rotating, the ball opening periodically aligns with the feed opening thereby permitting one tennis ball to pass through the feed opening from the tennis ball hopper for each time of alignment; and a lateral deflector positioned below the feed opening that is configured to deflect tennis balls that pass through the feed opening toward the entry portion of the curved rail and where the entirety of the lateral deflector is vertically spaced above and apart from the curved rail.

The tennis ball projecting machine can optionally also comprise a side surface positioned adjacent to both the lateral deflector and the wheel such that tennis balls deflected by the lateral deflector impact the side surface and/or a damping material on the side surface configured to cushion tennis balls deflected by the lateral deflector that impact the side surface. A vertical central plane of the wheel optionally does not intersect the feed opening of the upper surface that tennis balls pass through.

The tennis ball projecting machine can optionally also comprise a rotatable body that defines plural ball openings each sized for a single ball, wherein when rotating, each of the openings sequentially aligns with the feed opening, and in which there is a barrier positioned to prevent additional balls from entering an opening when the opening is aligned to allow the single ball to leave the opening and pass through the feed opening.

The tennis ball projecting machine can optionally also comprise an enclosure that contains the support member, the wheel, the wheel motor, the curved rail and the lateral deflector, where the enclosure defines an exit opening aligned with the exit portion of the curved rail.

The tennis ball projecting machine can optionally also have both the enclosure and the tennis ball hopper substantially congruent in shape and/or substantially congruent in material thickness. To increase a launch angle of the exit portion of the curved rail, the enclosure can optionally define an up angle opening on a bottom surface of the enclosure configured to receive the upper portion of a tennis ball positioned partly below the machine to angle the tennis ball projecting machine. To angle the tennis ball projecting machine to decrease a launch angle of the exit portion of the curved rail, the enclosure can optionally define a down angle opening on a bottom surface of the enclosure configured to receive the upper portion of a tennis ball positioned partly below the machine. The support member can optionally span from the front to the back of the enclosure.

The lateral deflector can optionally be formed as a ramp. The lateral deflector and the support member can optionally be unitarily constructed from a single piece. The lateral deflector can optionally be coupled to the upper surface adjacent the feed opening.

Alternatively, a tennis ball projecting machine comprising a base member having generally vertically oriented sides; and a ball hopper member positioned above the base member and having substantially vertically oriented sides that are substantially congruent in external shape with the base member's sides.

The sides of the base member are optionally slightly tilted from vertical so as to have a smaller horizontal cross section near its top than near its bottom, and the ball hopper member's sides are optionally substantially congruent but inverted shape from the base member's sides so as to have a smaller horizontal cross section near its bottom than near its top when configured for the machine to operate with its ball hopper in use.

The ball hopper member is optionally removable from the base member and when removed and inverted, can optionally be nested over the base member for storage or transport. The sides of the base member and the ball hopper member are optionally constructed of plastic. The sides of the base member are optionally the same thickness. A horizontal section through the sides of the base member optionally form a square or rectangular shape. The base member and the ball hopper member can optionally be formed using the same mold.

The tennis ball projecting machine can optionally be made from a molded base member and a molded ball hopper member in which the base member has a pitch exit hole not found in the ball hopper member, with the pitch exit hole having been created by using a blocking member in the same mold that otherwise could be used to make the ball hopper member when it is molded.

Yet another alterative is a tennis ball projecting machine comprising a motor, a vertically oriented pitching wheel rotating about a horizontal axis by the motor, a tennis ball hopper higher than the motor and the pitching wheel, a ball dispensing wheel adjacent the base of the tennis ball hopper, with plural openings in the wheel each sized to capture a single tennis ball from the hopper, a feed opening below the ball dispensing wheel in a position that a ball when passing through does not intersect a vertical plane central to the width of the pitching wheel, a first lateral deflector below the feed opening; and a curved rail pathway positioned below the first lateral deflector, with the path leading to below the pitching wheel and upwards thereafter.

The tennis ball projecting machine can optionally use the lateral deflector as a ramp. The tennis ball projecting machine can optionally use a ball dispensing wheel with exactly four openings each sized to capture a single tennis ball.

Yet another alternative is a tennis ball projecting machine having a ball launch angle adjusted by placing a tennis ball under the base of the machine comprising: a case containing a tennis ball pitching machine having a ball launch angle that it pitches when placed on level ground without any tennis balls extending beneath it, a bottom face on the case that contains openings into which a tennis ball will fit part way in (but not pass completely into) so as to have the tennis ball extend partially below the bottom face, at least one of the openings being positioned on the bottom face in a location in which a tennis ball in one of said openings would raise that portion of the bottom face to a higher level than other portions of the bottom face so that the ball launch angle is thereby adjusted.

Optionally, the tennis ball projecting machine can include an angle-increasing-opening containing a tennis ball that causes the ball launch angle to become higher when on level ground with a tennis ball in the opening. In addition or in the alternative, the tennis ball projecting machine can optionally include an angle-decreasing-opening containing a tennis ball that causes the ball launch angle to become lower when on level ground with a tennis ball in the opening.

DESCRIPTION OF THE ILLUSTRATED EMBODIMENTS

Figure 1:
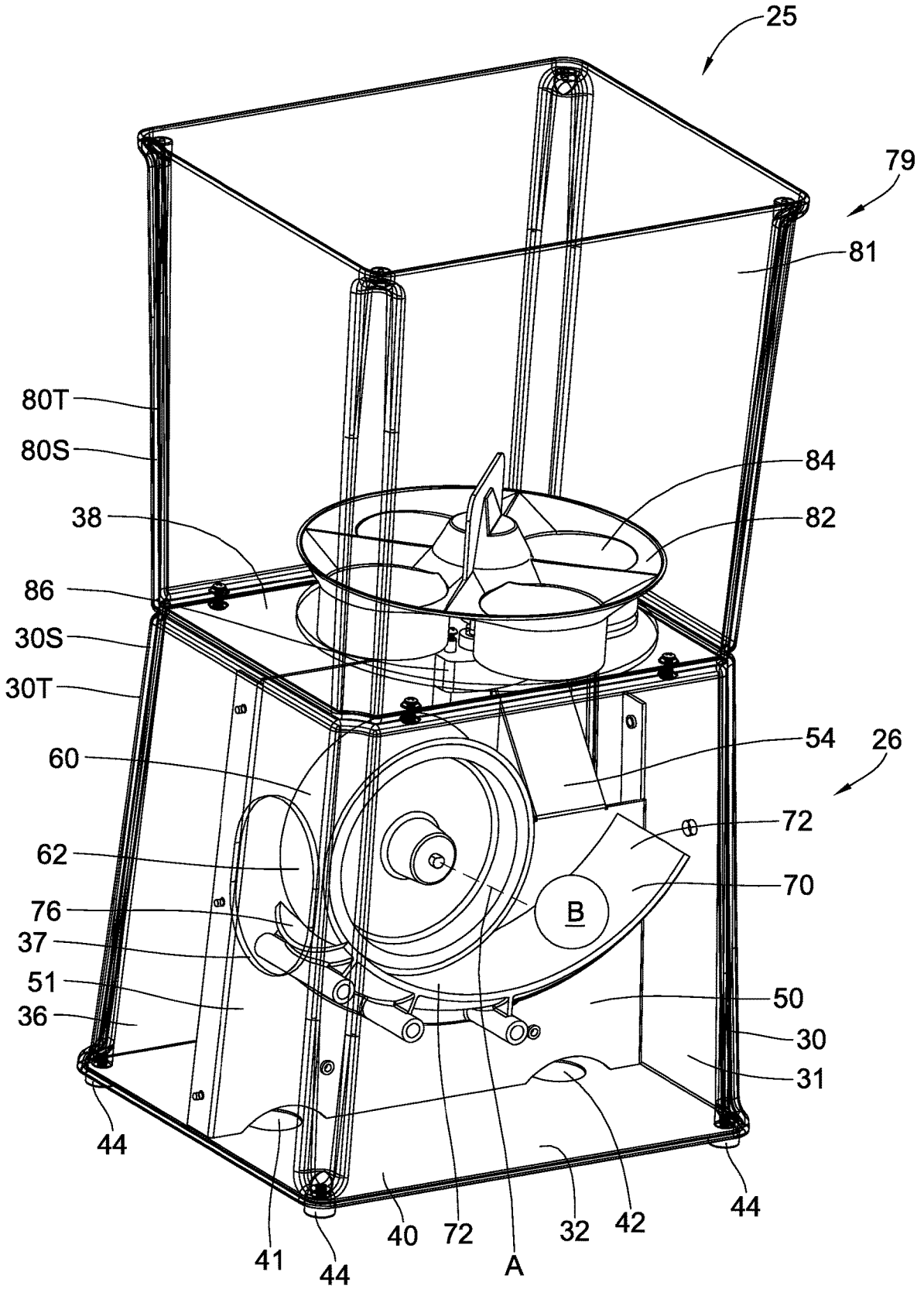
FIG. 1 is a perspective view of a tennis ball projecting machine including a base assembly and a hopper with transparent outer surfaces.
Figure 2:
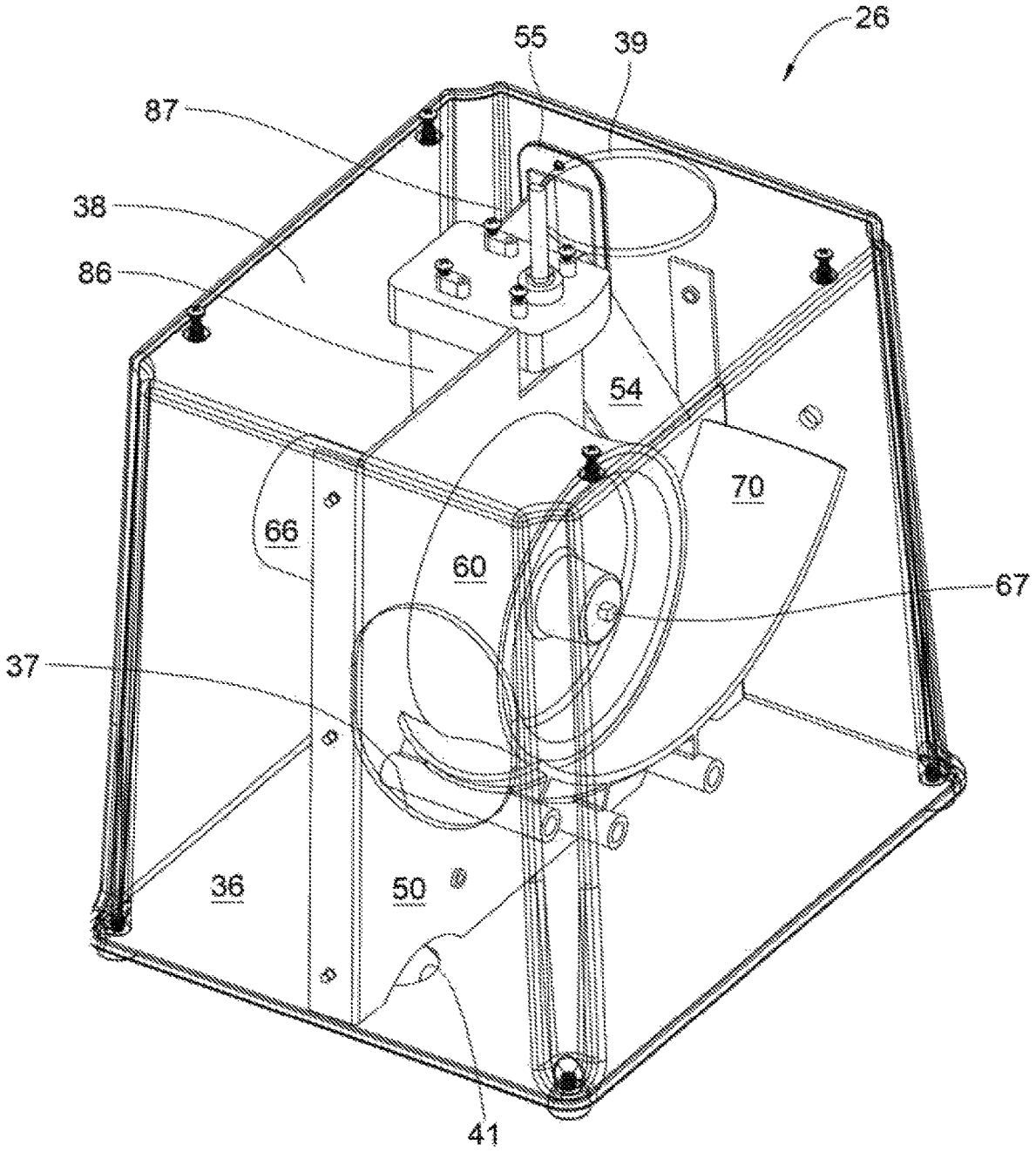
FIG. 2 is a perspective view of the base assembly of FIG. 1 with transparent outer surfaces.

For the purposes of promoting an understanding of the principles of what is claimed, reference will now be made to embodiments illustrated in the drawings and specific language will be used to describe the same. It will nevertheless be understood that no limitation of the scope of the claims is thereby intended. Any alterations and further modifications in the illustrated device, and any further applications of the principles disclosed and illustrated herein are contemplated as would normally occur to one skilled in the art to which the disclosure relates.

With respect to the specification and claims, it should be noted that the singular forms "a", "an", "the", and the like include plural references unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation unless expressly claimed.

Referring to FIG. 1, tennis ball projecting machine 25 is shown. Tennis ball projecting machine 25 generally includes base assembly 26 and hopper assembly 79.

Referring to FIGS. 2-6, base assembly 26 generally includes enclosure 30 which defines interior space 31 having a width at the top WT and a width at the bottom WB, a shape 30S and wall thickness 30T. Enclosure 30 includes side surfaces 32, front and back surfaces 36, upper surface 38, bottom surface 40 and feet 44. Note that the figures present these surfaces as transparent for clarity of illustration. As shown, horizontal sections through the sides of enclosure 30 optionally form a quadrilateral. Front surface 36 defines exit opening 37 which is aligned with ball lifting portion 76 of curved rail 70. Upper surface 38 defines feed opening 39. Bottom surface 40 defines up angle opening 41 and down angle opening 42.

Interior space 31 within enclosure 30 generally contains optional damping member 34, support member 50, lateral deflector 54, controller 55, battery 56, wheel 60, wheel motor 66, curved rail 70 and motor 86. Support member 50 defines side 51 and side 52 opposite side 51 within interior space 31 with wheel 60 and curved rail 70 positioned on side 51 and wheel motor 66 positioned on side 52 of support member 50. In the illustrated embodiment, support member 50 spans width W of enclosure 30. Support member 50 also defines notches 53 positioned above up angle opening 41 and down angle opening 42 to allow openings 41 and 42 to optionally receive a tennis ball as described below. Lateral deflector 54 is positioned below feed opening 39. Lateral deflector 54 is configured to deflect tennis balls that pass through feed opening 39 toward side surface 32 on side 51. Side surface 32 optionally includes damping material 34 configured to cushion tennis balls deflected by lateral deflector 54 toward side surface 32.

Controller 55 controls rotation of motors 66 and 86. Controller 55 may optionally include one or more preset rotation speeds for each motor 66 and 86 selectable by an operator input such as a multi-position switch or toggle. Controller 55 may optionally include a variable input such as a speed pot to provide a large number of different possible rotations speeds for motors 66 and/or 86. Controller 55 may optionally receive feedback from motors 66 and/or 86 to account for variable loads on motors 66 and/or 86 to provide more consistent motor speed.

Operation of the illustrated embodiments is powered by battery 56. In alternative embodiments, power could alternatively be provided by an external power source such as an AC power supply connected to tennis ball projecting match 25 by a power cord or the like in addition to or instead of battery 56.

In the illustrated embodiment, the sides of enclosure 30, including side surface 32 and front surface 36, are slightly tilted from vertical so as to define a smaller overall horizontal cross section near the top of enclosure 30 than near its bottom. Conversely, the sides of hopper 80 are substantially congruent but inverted in shape from the sides of enclosure 30 so as to have a smaller horizontal cross section near the bottom of hopper 80 than near its top (when configured for the machine to operate with its ball hopper in use).

In the illustrated embodiment, lateral deflector 54 is configured as a ramp that is formed from a portion of support member 50 that has been bent away from vertical. In this embodiment, lateral deflector 54 and support member 50 are unitarily constructed from a single piece of material. In other embodiments (not shown), lateral deflector 54 can have a different shape and could be a separate component from support member 50. Lateral deflector 54 could also optionally be supported by other structures such as enclosure 30. Lateral deflector 54 can optionally be coupled to upper surface 38 adjacent feed opening 39.

Figure 3:
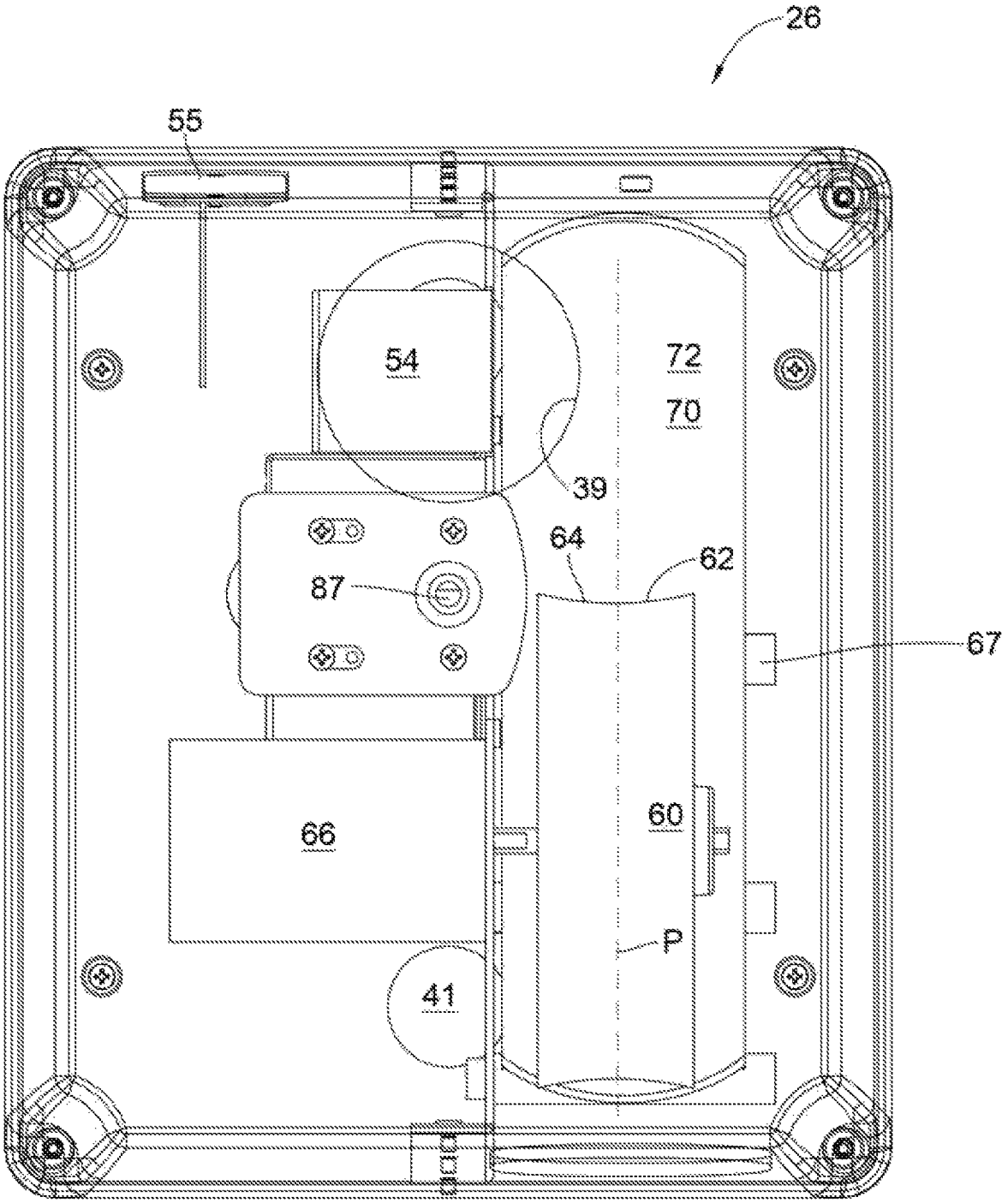
FIG. 3 is a top plan view of the base assembly of FIG. 2 with a transparent top.
Figure 4:
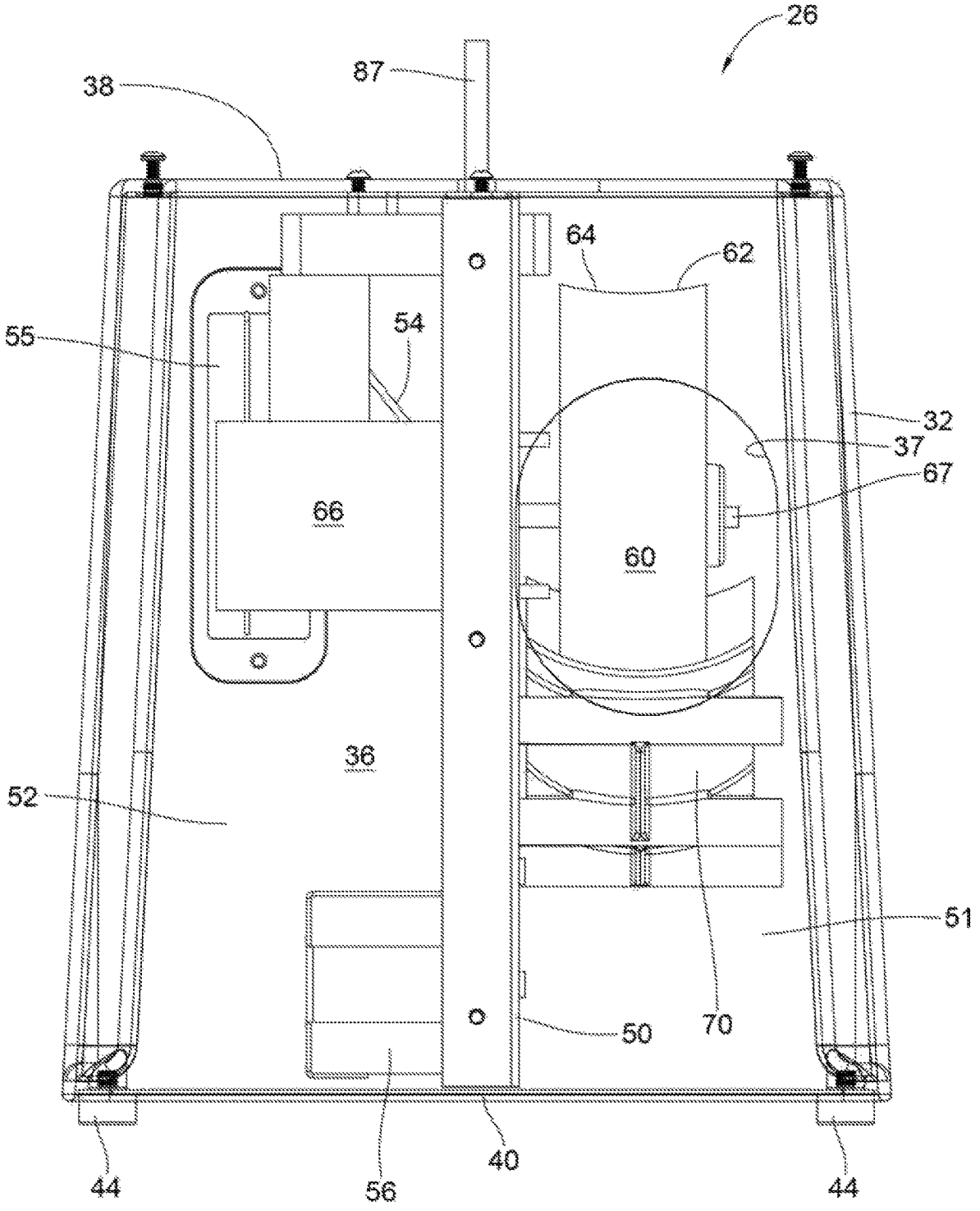
FIG. 4 is a front elevational view of the base assembly of FIG. 2 with a transparent front panel.

Wheel 60 has an axis of rotation A that extends along shaft 67 which connects wheel motor 66 to wheel 60. Wheel motor 66 rotates shaft 67 and wheel 60. Wheel 60 defines vertical central plane P which extends through the center of wheel 60 perpendicularly to axis of rotation A. Wheel 60 includes outer surface 62 that defines concave profile 64. In alternative embodiments, wheel 60 could optionally include a flat profile (not shown) instead of a concave profile. As best shown in FIG. 3, vertical central plane P is spaced apart from and does not intersect feed opening 39.

Figure 5:
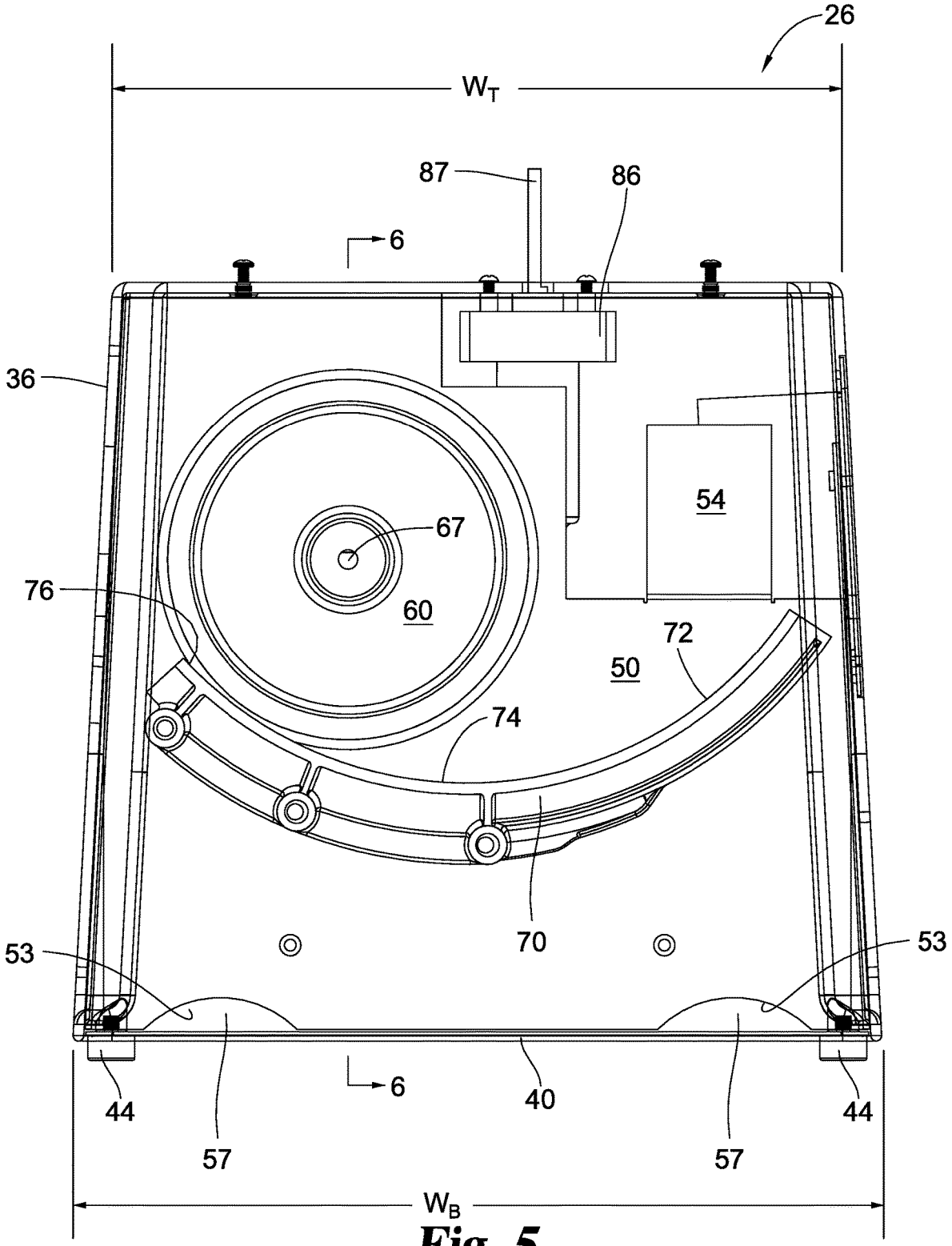
FIG. 5 is a right side elevational view of the base assembly of FIG. 2 with a transparent right side panel.
Figure 6:
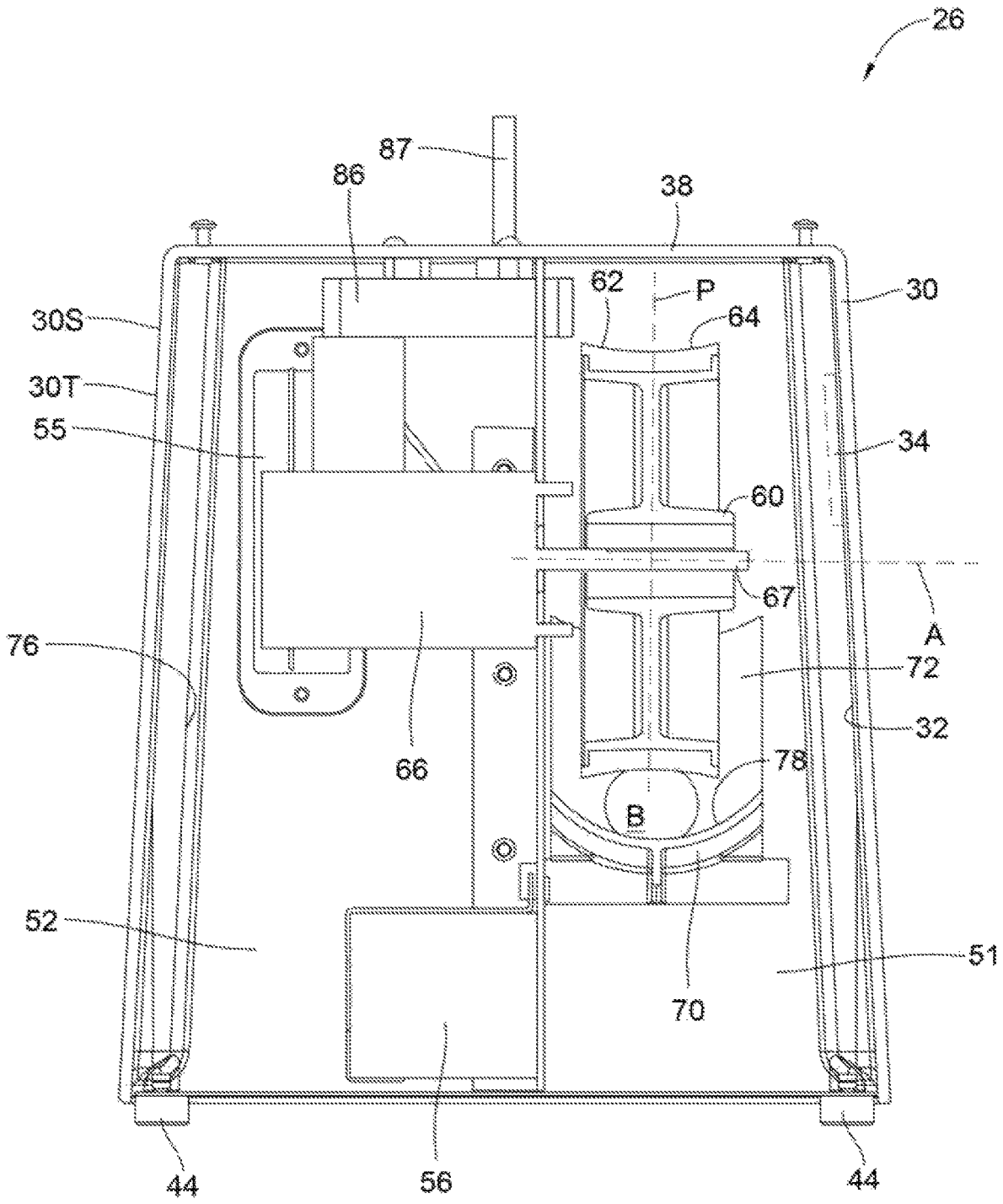
FIG. 6 is a cross section view of the base assembly of FIG. 2 taken along line 6-6 in FIG. 5.

Curved rail 70 includes ball entry portion 72, ball drive portion 74 and ball lifting portion 76. Curved rail 70 also defines concave profile 78. In an alternative embodiment, curved rail could optionally include a flat profile (not shown) instead of a concave profile. Concave profiles 64 and 78 are preferably adapted to urge balls B pinched between wheel 60 and curved rail 70 to align with vertical central plane P. As best shown in FIG. 5, ball entry portion 72 is positioned below lateral deflector 54. Ball entry portion 72 is sloped downwardly to urge balls on ball entry portion 72 toward wheel 60 and ball drive portion 74. Ball drive portion 74 is positioned in the area between wheel 60 and curved rail 70 where ball B is pinched between wheel 60 and curved rail 70 and driven toward ball lifting portion 76 by the rotation of wheel 60. Ball lifting portion 76 is the last portion of curved rail 70 that ball B passes over before being projected away through exit opening 37 due to the speed imparted by the rotation of wheel 60. Ball lifting portion is sloped upwardly to give the ball an initial upward trajectory when projected. Wheel 60 and curved rail 70 impart topspin on projected balls due to the rotation of wheel 60 over stationary curved rail 70.

Figure 7:
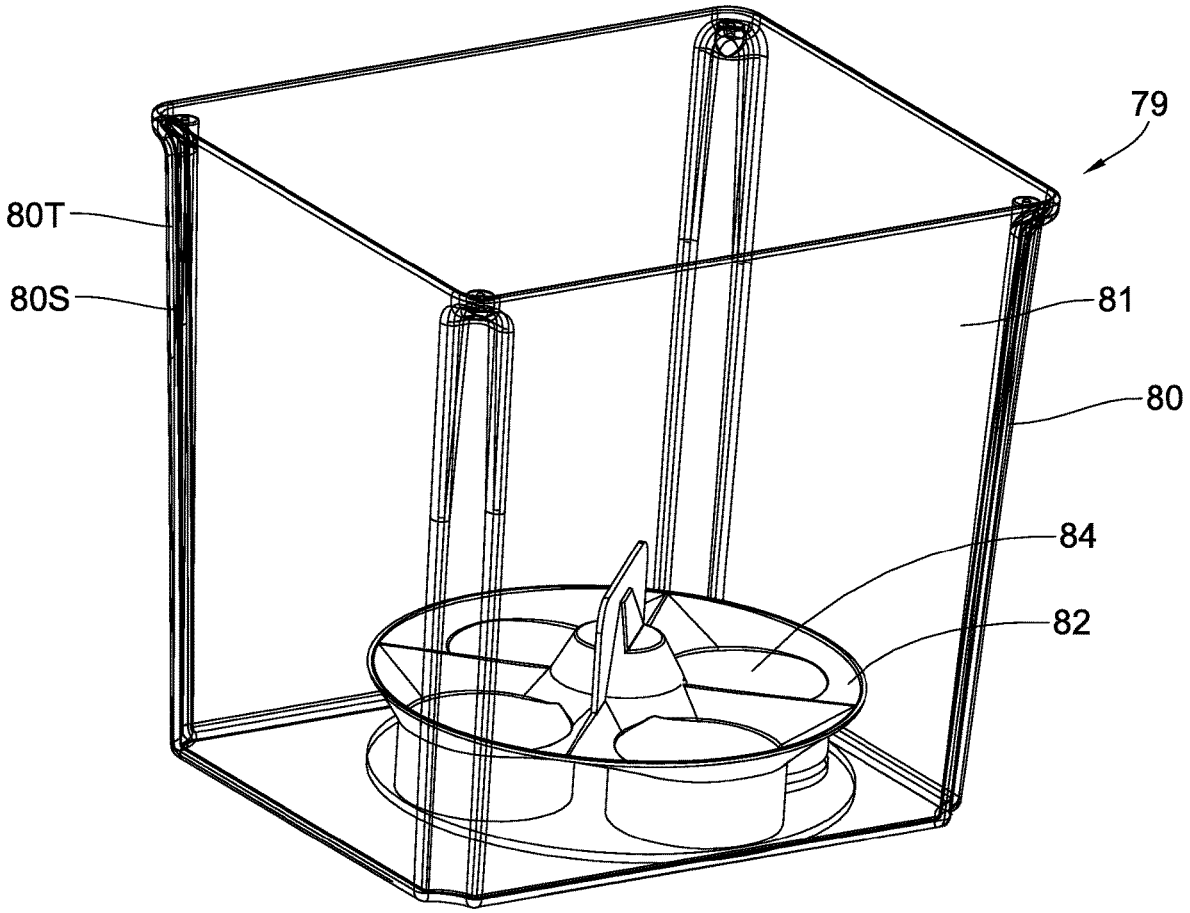
FIG. 7 is a perspective view of the hopper of FIG. 1 with transparent outer surfaces.
Figure 8:
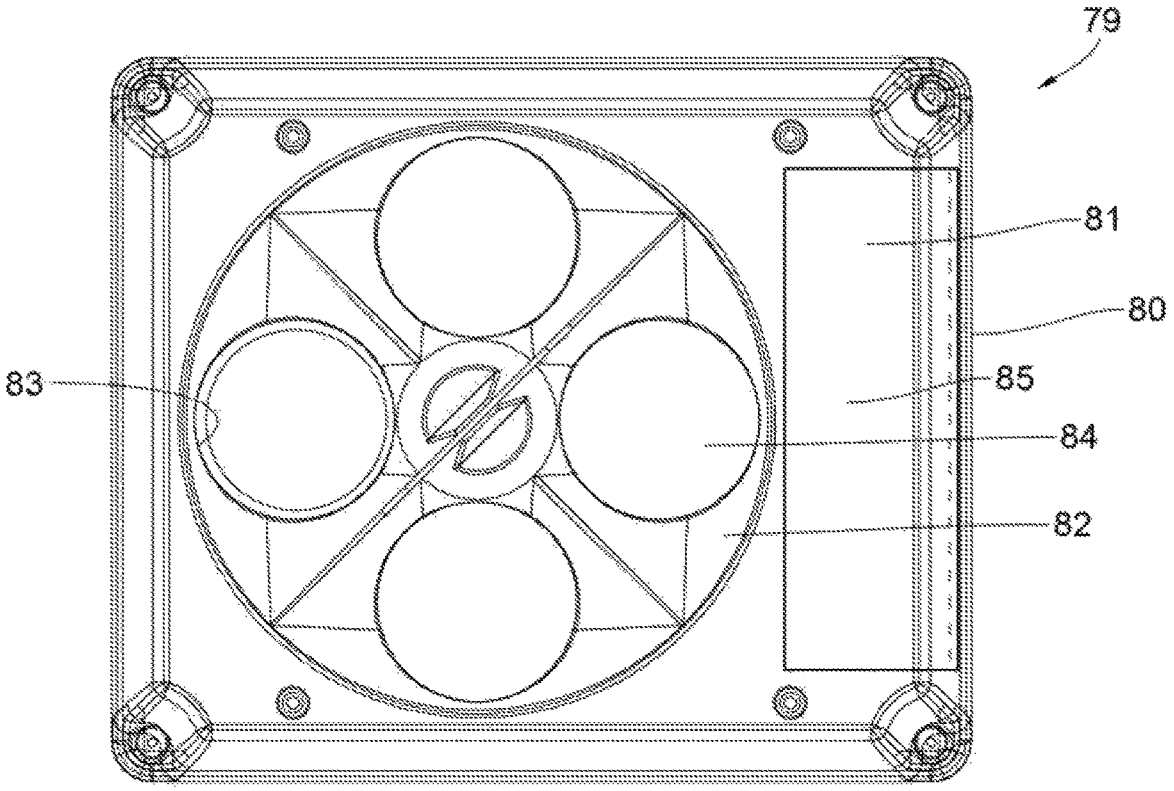
FIG. 8 is a top plan view of the hopper of FIG. 7.

Referring to FIGS. 7 and 8, hopper assembly 79 is illustrated. Hopper assembly 79 generally includes hopper 80, rotatable body 82 and deflector 85. Hopper 80 defines containment space 81, shape 80S and wall thickness 80T. Hopper 80 also defines exit opening 83 that is aligned with feed opening 39 of enclosure 30. Exit opening 83 can optionally be larger than feed opening 39. Rotatable body 82 defines a number of ball openings 84. Rotatable body 82 is coupled to shaft 87 such that motor 86 rotates rotatable body 82.

Deflector 85 is optionally positioned within hopper 80 to block balls B from falling into the gap between rotatable body 82 and hopper 80. Deflector 85 is optionally angled approximately 75 degrees from the sidewall of hopper 80 so that deflector 85 assists in feeding balls positioned above deflector 85 toward rotatable body 82.

Hopper 80 and enclosure 30 may optionally be formed from molded plastic, such as injection molded plastic, rotationally molded plastic, blow molded plastic, thermoformed plastic or any other desired forming technique. Hopper 80 and enclosure 30 may optionally be formed using the same or using similar molds such that shape 30S and 80S are substantially congruent and wall thickness 30T and 80T are also substantially congruent. In the illustrated embodiment shape 30S and 80S are the same and wall thickness 30T and 80T are the same. When using the same mold for both hopper 80 and enclosure 30, features unique to one of hopper 80 or enclosure 30 can optionally be formed using a blocking member in the mold to form features such as exit opening 37 and exit opening 83.

Ball openings 84 are configured to periodically align with feed opening 39 (and optionally exit opening 83) due to rotation of rotatable body 82 by motor 86 to permit a single ball B contained in containment space 81 to pass through ball opening 84, exit opening 83 and feed opening 39 thereby dropping onto lateral deflector 54. The overall geometry of rotatable body 82, including the size and shape of ball openings 84, is configured to prevent more than a single ball B from passing through feed opening 39 (and exit opening 83) during a single alignment of ball opening 84 with feed opening 39 while rotatable body 82 is rotating.

Rotation of motor 86 is controlled by controller 55. The rotation speed of motor 86 is controlled based on the angular spacing of ball openings 84 to provide a desired frequency of periodic alignment to control the frequency at which individual balls are feed into base assembly to be projected. In the illustrated embodiment, 4 ball openings are provided in rotatable body 82. In other embodiments, additional or fewer ball openings could be used.

Tennis ball throwing machine 25 operates as follows. First, controller 55 includes speed controllers for motors 66 and 86 with preset operating conditions including as projection frequency and projection speed. Controller 55 then determines rotational speeds for motors 66 and 86 to achieve the programed parameters. Controller 55 may optionally be configured with feedback from motors 66 and/or 86 to provide approximately constant rotational speed with variable resistance. Hopper 80 is filled with a number of balls B, with individual balls being sorted by gravity and the geometry of rotatable body 82. As rotatable body 82 rotates, an individual ball opening aligns with exit opening 83 and feed opening 39 which permits a single ball B to drop through. The dropped ball B contacts lateral deflector 54 which deflects the ball B toward side surface 32. As it heads toward side surface 32, ball B optionally contacts damping material 34 which optionally cushions ball B, and optionally absorbs some of the momentum of ball B. Ball B then drops down onto ball entry portion 72 of curved rail 70. Ball B then rolls down toward ball drive portion 74 due to ball entry portion 72 being sloped downward toward ball drive portion 74. Ball B is then pinched between wheel 60 and curved rail 70 and is driven toward ball lifting portion 76 due to the rotation of wheel 60. Ball B is then projected off ball lifting portion and exits through exit opening 37 with an upward trajectory and topspin.

Note that due to the illustrated configuration with hopper 80 positioned above enclosure 30 there are two surfaces between hopper assembly 79 and base assembly 26: an unlabeled surface on the bottom of hopper 80 and upper surface 38. A tennis ball projecting machine could alternatively be constructed with a single surface or barrier between hopper assembly 79 and base assembly 26. Such a single surface or barrier could be unitary with other components or it could be removably attached. In yet another embodiment, exit opening 83 the bottom of hopper 80 can optionally be much larger than feed opening 39 such that effectively upper surface 38 is the only barrier between hopper assembly 79 and base assembly 26. In one embodiment (not illustrated) exit opening 83 is approximately the size of the outer profile of rotatable body 82 and approximately aligned with rotatable body 82.

Figure 9:
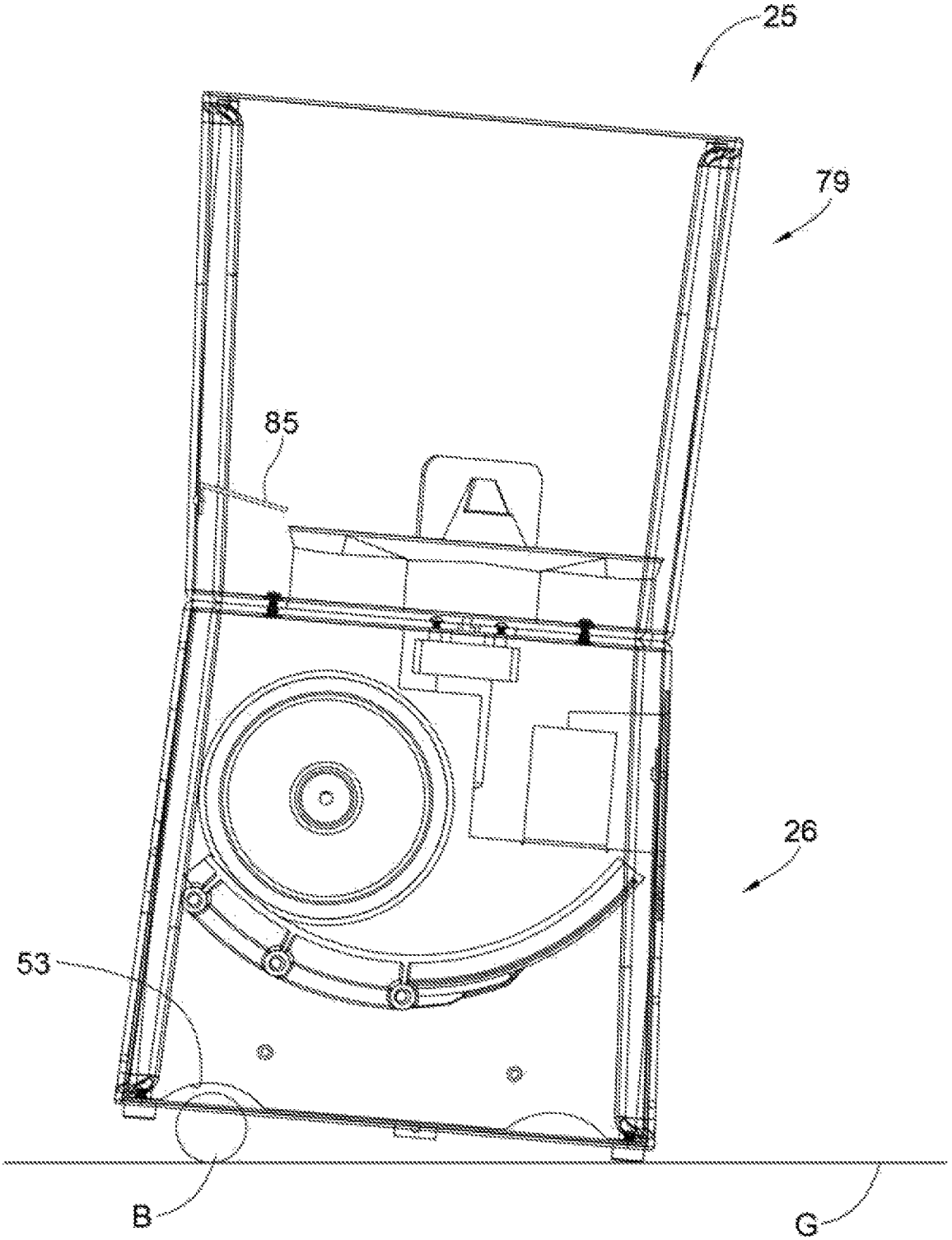
FIG. 9 is a right side elevational view of the FIG. 1 tennis ball projecting machine with transparent right side panels configured with an elevated launch angle.
Figure 10:
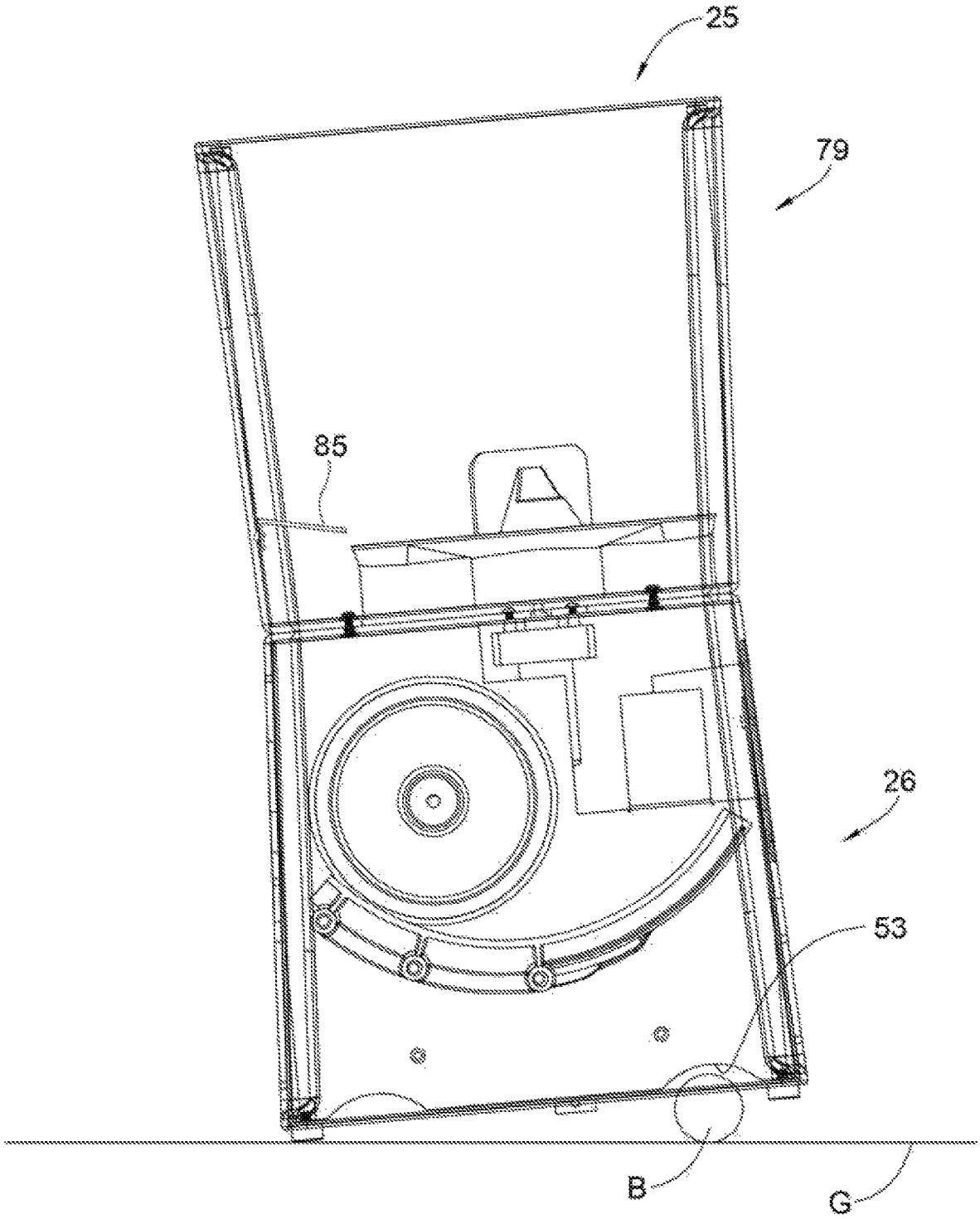
FIG. 10 is a right side elevational view of the FIG. 1 tennis ball projecting machine with transparent right side panels configured with a reduced launch angle.

Referring to FIGS. 9 and 10, adjustment of the projecting angle is illustrated. In FIG. 9, ball B is inserted into up angle opening 41 such that ball B lifts the front feet 44 off the ground and angles the entire tennis ball projecting machine relative to the ground, resulting in increasing the effective angle of projection leaving curved rail 70 relative to ground G. In FIG. 10, ball B is inserted into down angle opening 42 such that ball B lifts the rear feet 44 off the ground and angles the entire tennis ball projecting machine relative to the ground, resulting in a decrease of the effective angle of projection leaving curved rail 70 relative to ground G.

Hopper 80 could optionally be configured to be removable from enclosure 30. When removed, hopper 80 could optionally be inverted and nested over enclosure 30 for storage or transport.

While the claimed subject matter has been illustrated and described in detail in the drawings and foregoing description, the same is to be considered as illustrative and not restrictive in character. All changes and modifications that come within the spirit of the disclosure are desired to be protected by the claims.

I claim:

1. A tennis ball projecting machine for use with tennis balls, the tennis ball projecting machine comprising:

a base member having generally vertically oriented sides; and a ball hopper member positioned above the base member and having substantially vertically oriented sides that are substantially congruent in external shape with the base member's sides in which the sides of the base member are slightly tilted from vertical so as to have a smaller horizontal cross section near its top than near its bottom, and the ball hopper member's sides are substantially congruent but inverted shape from the base member's sides so as to have a smaller horizontal cross section near its bottom than near its top when configured for the machine to operate with its ball hopper in use and in which the ball hopper member is removable from the base member and when removed and inverted nests over the base member for storage or transport.

2. A The tennis ball projecting machine of claim 1 further comprising:

a support member having a first side and a second side opposite the first;

a wheel rotatably mounted on the first side of the support member with the wheel being vertically oriented about a horizontal axis of rotation;

a wheel motor mounted on the second side of the support member and having its output coupled to the wheel on the first side of the support member to rotate the wheel, a curved rail positioned below the wheel, wherein the curved rail comprises a ball entry portion, a ball drive portion and a ball lifting portion, wherein the curved rail is positioned on the first side of the support member, wherein the entry portion is slanted downwardly toward the wheel such that tennis balls on the entry portion roll toward the wheel, and wherein tennis balls on the drive portion are pinched between the wheel and curved rail for acceleration by the wheel and wherein the ball-lifting portion is slanted upwardly away from the wheel such that tennis balls on the ball-lifting portion move upward for being thrown from the exit portion with an upward trajectory;

wherein the tennis ball hopper is positioned vertically above the support member;

an upper surface positioned under the tennis ball hopper, wherein the upper surface defines a feed opening adapted to allow selective passage of a tennis ball and wherein at least the portion of the feed opening that tennis balls pass through is positioned on the second side of the support member;

a rotatable body positioned above the top surface, wherein the rotatable body defines a ball opening, wherein the rotatable body is positioned such that, when rotating, the ball opening periodically aligns with the feed opening thereby permitting one tennis ball to pass through the feed opening from the tennis ball hopper for each time of alignment; and a lateral deflector positioned below the feed opening, wherein the lateral deflector is configured to deflect tennis balls that pass through the feed opening toward the entry portion of the curved rail and wherein the entirety of the lateral deflector is vertically spaced above and apart from the curved rail.

3. The tennis ball projecting machine of claim 2, further comprising a side surface positioned adjacent both the lateral deflector and the wheel, wherein tennis balls deflected by the lateral deflector impact the side surface.

4. The tennis ball projecting machine of claim 3, further comprising a damping material on the side surface configured to cushion tennis balls deflected by the lateral deflector that impact the side surface.

5. The tennis ball projecting machine of claim 2, wherein a vertical central plane of the wheel does not intersect the feed opening of the upper surface that tennis balls pass through.

6. The tennis ball projecting machine of claim 2, further comprising a rotatable body that defines plural ball openings each sized for a single ball, wherein when rotating, each of the openings sequentially aligns with the feed opening, and in which there is a barrier positioned to prevent additional balls from entering an opening when the opening is aligned to allow the single ball to leave the opening and pass through the feed opening.

7. The tennis ball projecting machine of claim 2, further comprising an enclosure that contains the support member, the wheel, the wheel motor, the curved rail and the lateral deflector, wherein the enclosure defines an exit opening aligned with the exit portion of the curved rail.

8. The tennis ball projecting machine of claim 7, wherein the enclosure and the tennis ball hopper are substantially congruent in material thickness.

9. The tennis ball projecting machine of claim 7, wherein the enclosure defines an up angle opening on a bottom surface of the enclosure, wherein the up angle opening is configured to receive the upper portion of a tennis ball positioned partly below the machine to angle the tennis ball projecting machine to increase a launch angle of the exit portion of the curved rail.

10. The tennis ball projecting machine of claim 7, wherein the enclosure defines a down angle opening on a bottom surface of the enclosure, wherein the down angle opening is configured to receive the upper portion of a tennis ball positioned partly below the machine to angle the tennis ball projecting machine to decrease a launch angle of the exit portion of the curved rail.

11. The tennis ball projecting machine of claim 7, wherein the support member spans a width of the enclosure.

12. The tennis ball projecting machine of claim 7, wherein the horizontal position of the feed opening is centered relative to the enclosure.

13. The tennis ball projecting machine of claim 2, wherein the lateral deflector is a ramp.

14. The tennis ball projecting machine of claim 2, wherein the lateral deflector and the support member are unitarily constructed from a single piece.

15. The tennis ball projecting machine of claim 2, wherein the lateral deflector is coupled to the upper surface adjacent the feed opening.

16. The tennis ball projecting machine claim 1 in which the sides of the base member and the ball hopper member are plastic.

17. The tennis ball projecting machine of claim 1 in which the sides of the base member are the same thickness.

18. The tennis ball projecting machine of claim 1 in which a horizontal section through the sides of the base member form a quadrilateral.

19. The tennis ball projecting machine of claim 16 in which the same mold can be used to make the base member and the ball hopper member.

20. The tennis ball projecting machine of claim 1 made from a molded plastic base member and a molded plastic ball hopper member in which the base member has a pitch exit hole not found in the ball hopper member, with the pitch exit hole having been created by using a blocking member in the same mold that otherwise could be used to make the ball hopper member when it is molded.

21. The tennis ball projecting machine of claim 1 further comprising:

a motor;

a vertically oriented pitching wheel rotating about a horizontal axis by the motor;

a tennis ball hopper higher than the motor and the pitching wheel;

a ball dispensing wheel adjacent the base of the tennis ball hopper, with plural openings in the wheel each sized to capture a single tennis ball from the hopper, a feed opening below the ball dispensing wheel in a position that a ball when passing through does not intersect a vertical plane central to the width of the pitching wheel;

a first lateral deflector below the feed opening; and a curved rail pathway positioned below the first lateral deflector, with the path leading to below the pitching wheel and upwards thereafter.

22. The tennis ball projecting machine of claim 21 in which said lateral deflector is a ramp.

23. The tennis ball projecting machine of claim 21 in which the ball dispensing wheel has exactly four openings each sized to capture a single tennis ball.

24. A The tennis ball projecting machine of claim 1 further comprising:

a case containing a tennis ball pitching machine having a ball launch angle that it pitches when placed on level ground without any tennis balls extending beneath it;

a bottom face on the case that contains openings into which a tennis ball will fit part way in (but not pass completely into) so as to have the tennis ball extend partially below the bottom face;

at least one of the openings being positioned on the bottom face in a location in which a tennis ball in one of said openings would raise that portion of the bottom face to a higher level than other portions of the bottom face so that the ball launch angle is adjusted thereby.

25. The tennis ball projecting machine of claim 24 in which there is an angle-increasing-opening containing a tennis ball that causes the ball launch angle to become higher when on level ground with a tennis ball in the opening.

26. The tennis ball projecting machine of claim 24 in which there is an angle-decreasing-opening containing a tennis ball that causes the ball launch angle to become lower when on level ground with a tennis ball in the opening.

* * * * *